US009404683B2

(12) United States Patent
Miller et al.

(10) Patent No.: US 9,404,683 B2
(45) Date of Patent: Aug. 2, 2016

(54) REFRIGERATOR APPLIANCE

(71) Applicant: General Electric Company, Schenectady, NY (US)

(72) Inventors: Charles Benjamin Miller, Louisville, KY (US); Alan Joseph Mitchell, Louisville, KY (US); Stephen Michael Bischoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 204 days.

(21) Appl. No.: 14/059,712

(22) Filed: Oct. 22, 2013

(65) Prior Publication Data

US 2015/0108886 A1 Apr. 23, 2015

(51) Int. Cl.

| | |
|---|---|
| ***A47B 96/04*** | (2006.01) |
| ***F25D 21/14*** | (2006.01) |
| ***F25D 23/02*** | (2006.01) |

(52) U.S. Cl.

CPC ..... *F25D 21/14* (2013.01); *F25D 23/028* (2013.01); *F25C 2400/10* (2013.01); *F25D 2323/024* (2013.01)

(58) Field of Classification Search

CPC ..... F25D 21/14; F25D 23/02; F25D 23/006; F25D 2321/144; F25D 2321/1441; F25D 2321/1442; F25D 2321/145; F25D 2321/146; F25D 23/068

USPC ..... 312/405

See application file for complete search history.

(56) References Cited

U.S. PATENT DOCUMENTS

| | | | | |
|---|---|---|---|---|
| 2,700,139 | A * | 1/1955 | Jewell | 439/31 |
| 4,912,942 | A * | 4/1990 | Katterhenry et al. | 62/338 |
| 5,359,795 | A * | 11/1994 | Mawby et al. | 40/405 |
| 5,787,724 | A * | 8/1998 | Pohl et al. | 62/389 |
| 5,941,619 | A * | 8/1999 | Stieben et al. | 312/223.6 |
| 6,708,518 | B1 | 3/2004 | Jones et al. | |
| 8,025,186 | B2 * | 9/2011 | Lee et al. | 222/146.6 |
| 8,240,159 | B2 | 8/2012 | Prabhakar et al. | |
| 2006/0144066 | A1 * | 7/2006 | Lee et al. | 62/238.6 |
| 2007/0251261 | A1 * | 11/2007 | Son et al. | 62/390 |
| 2010/0326112 | A1 * | 12/2010 | Prabhakar et al. | 62/259.1 |
| 2012/0118001 | A1 | 5/2012 | Mitchell et al. | |
| 2012/0324914 | A1 | 12/2012 | Bortoletto et al. | |
| 2014/0150460 | A1 * | 6/2014 | Boarman et al. | 62/3.3 |

* cited by examiner

*Primary Examiner* — Timothy M Ayres
(74) *Attorney, Agent, or Firm* — Dority & Manning, P.A.

(57) ABSTRACT

Refrigerator appliances are provided. A refrigerator appliance includes a cabinet defining a fresh food chamber and a freezer chamber and including a mullion extending between and defining the fresh food chamber and freezer chamber. The refrigerator appliance further includes a door rotatably hinged to the cabinet for accessing the fresh food chamber, the door including an inner surface and an outer surface, the door further including an ice container mounted thereon. The refrigerator appliance further includes a hinge connecting the mullion and the door, and a freezer door connected to the cabinet for accessing the freezer chamber. The refrigerator appliance further includes a drain assembly for draining a liquid from the ice container, the drain assembly providing a flow path through the hinge and the mullion to an exhaust location.

17 Claims, 9 Drawing Sheets

REFRIGERATOR APPLIANCE

FIELD OF THE INVENTION

The present disclosure related generally to refrigerator appliances, and more particularly to drain assemblies in refrigerator appliances for draining liquids from ice containers.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. Additionally, many refrigerator appliances include ice makers, which make ice and then retain the ice for dispensing to a user.

A current trend that is increasing in popularity is the desire for "nugget", or chewable, ice. Such ice is typically stored at a relatively higher than normal temperature such as above 32 degrees Fahrenheit in some cases. However, the desire for nugget ice has disadvantages. For example, such ice stored in an ice container of an ice maker will melt. The melted water may cause the ice to stick together and lead to other undesirable results.

Accordingly, improved refrigerator appliances are desired in the art. In particular, refrigerator appliances which provide improved ice container drainage would be advantageous.

BRIEF DESCRIPTION OF THE INVENTION

Additional aspects and advantages of the invention will be set forth in part in the following description, or may be apparent from the description, or may be learned through practice of the invention.

In accordance with one embodiment, a refrigerator appliance is disclosed. The refrigerator appliance includes a cabinet defining a fresh food chamber and a freezer chamber and including a mullion extending between and defining the fresh food chamber and freezer chamber. The refrigerator appliance further includes a door rotatably hinged to the cabinet for accessing the fresh food chamber, the door including an inner surface and an outer surface, the door further including an ice container mounted thereon. The refrigerator appliance further includes a hinge connecting the mullion and the door, and a freezer door connected to the cabinet for accessing the freezer chamber. The refrigerator appliance further includes a drain assembly for draining a liquid from the ice container, the drain assembly providing a flow path through the hinge and the mullion to an exhaust location.

In accordance with another embodiment, a refrigerator appliance is disclosed. The refrigerator appliance includes a cabinet defining a fresh food chamber and a freezer chamber, and a door rotatably hinged to the cabinet for accessing the fresh food chamber, the door including an inner surface and an outer surface, the door further including an ice container mounted thereon. The refrigerator appliance further includes a drain assembly for draining a liquid from the ice container, the drain assembly providing a flow path through the door and a sidewall of the cabinet to an exhaust location.

In accordance with another embodiment, a refrigerator appliance is disclosed. The refrigerator appliance includes a cabinet defining a fresh food chamber and a freezer chamber, and a door rotatably hinged to the cabinet for accessing the fresh food chamber, the door including an inner surface and an outer surface, the door further including an ice container mounted thereon. The refrigerator appliance further includes a drain assembly for draining a liquid from the ice container, the drain assembly including a drain reservoir, a pump, and a drain tube, the drain reservoir in fluid communication with the ice container, the pump in fluid communication with the drain reservoir, and the drain tube extending from the pump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
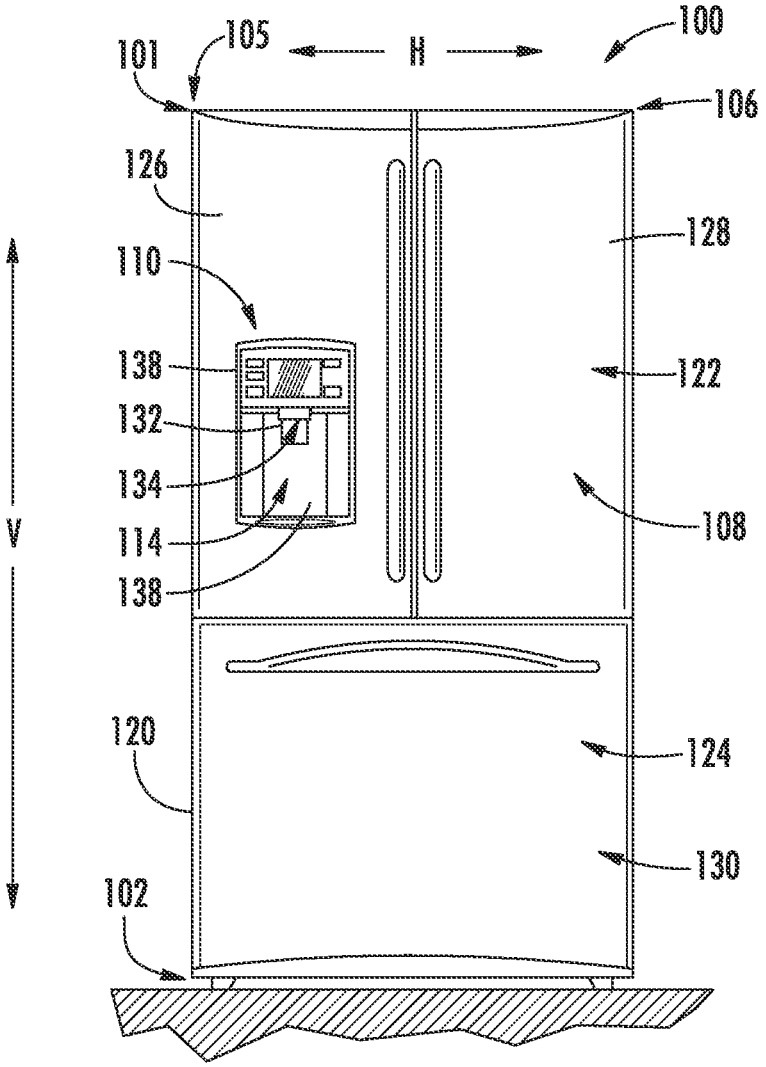
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 extends between a top 101 and a bottom 102 along a vertical direction V. Refrigerator appliance 100 also extends between a first side 105 and a second side 106 along a horizontal direction H. Further, refrigerator appliance 100 extends between a front 108 and a back 109 along a transverse direction T, which may be defined perpendicular to the vertical and horizontal directions T, H.

Refrigerator appliance 100 includes a cabinet or housing 120 defining an upper fresh food chamber 122 and a lower freezer chamber 124 arranged below the fresh food chamber 122 on the vertical direction V. As such, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or a top freezer appliance as well. Consequently, the description set forth herein is for illustrative purposes only and is not intended to limit the invention in any aspect.

Figure 9:
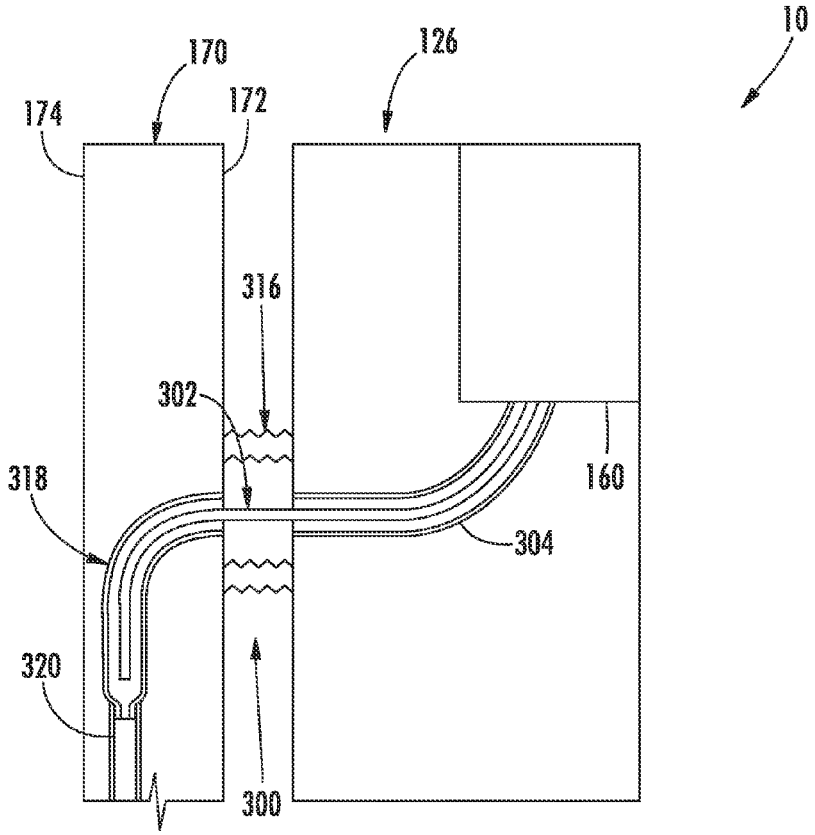
FIG. 9 provides a side view of a portion of a refrigerator appliance, according to an exemplary embodiment of the present subject matter.
Figure 10:
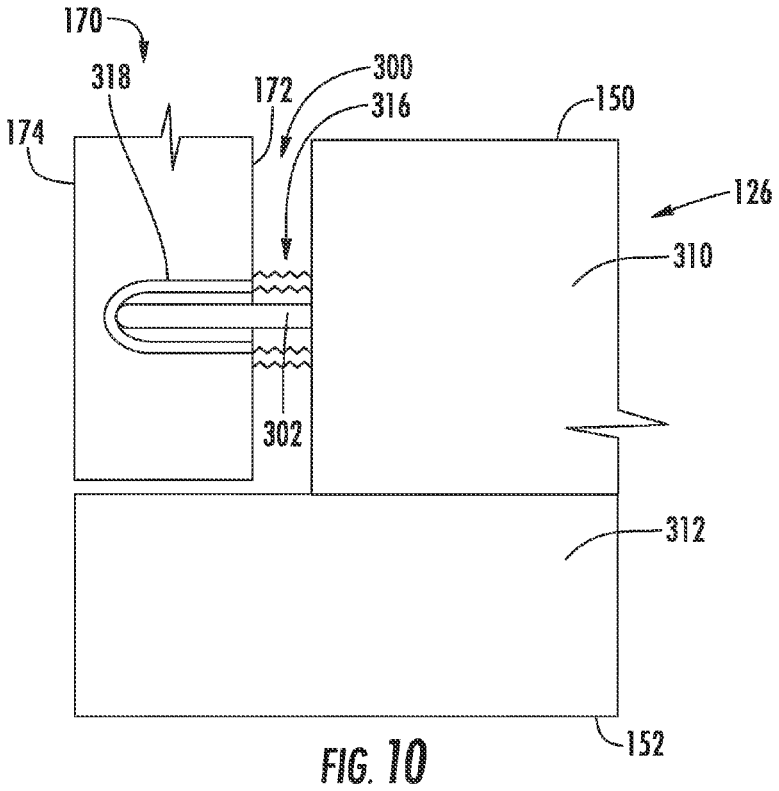
FIG. 10 provides a cross-sectional view of the refrigerator appliance of FIG. 9 with a refrigerator door in a closed position.
Figure 11:
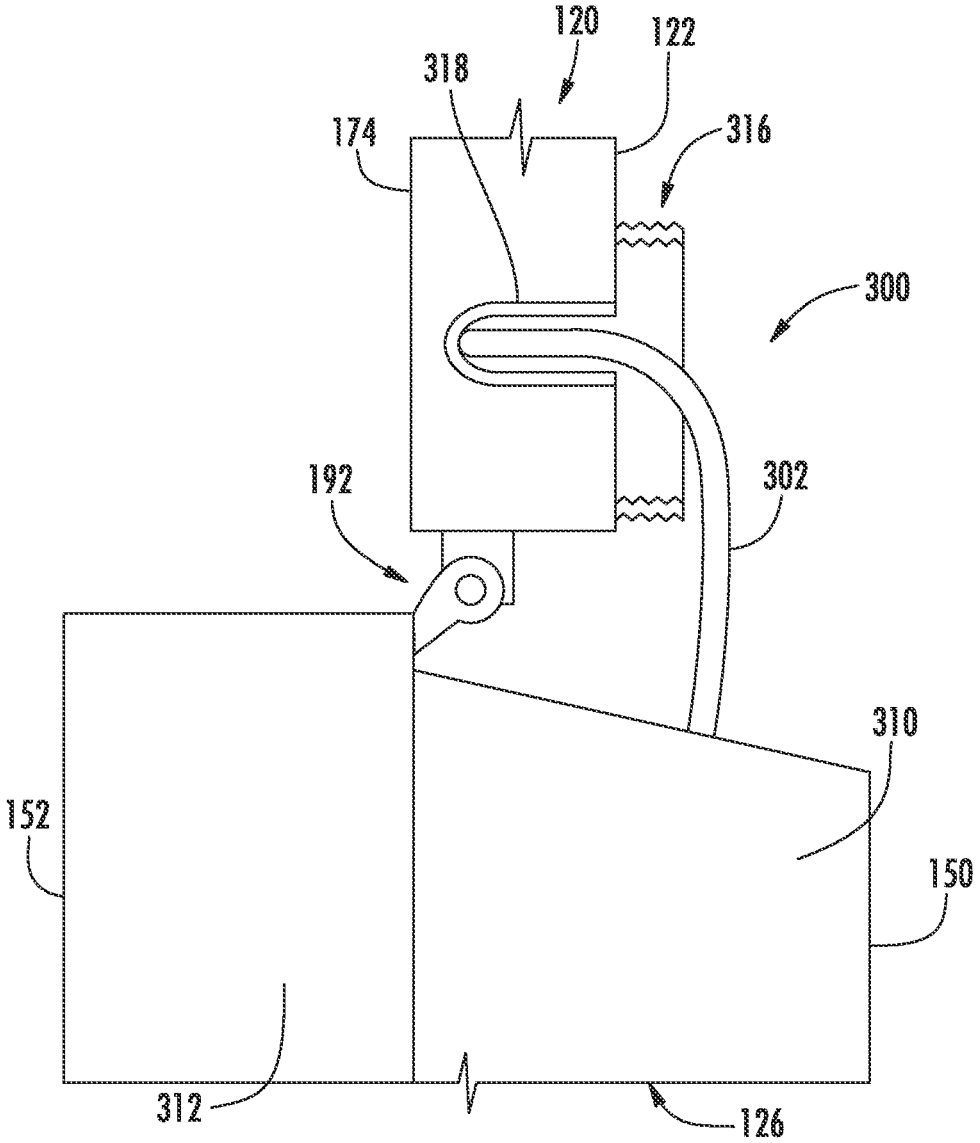
FIG. 11 provides a cross-sectional view of the refrigerator appliance of FIG. 9 with a refrigerator door in an open position.

Cabinet 120 generally is formed from a plurality of walls, including opposing sidewalls 170, each of which includes an inner surface 172 facing the chambers 122, 124 and an opposing outer surface 174 (see FIGS. 9 through 11). Additionally, a mullion 180 extends between the chamber 122 and chamber 124. In the embodiment illustrated, the mullion 180 extends generally along the horizontal direction H.

Refrigerator doors 126 are rotatably hinged to an edge of housing 120 for accessing fresh food chamber 122. For example, an upper hinge 190 and a lower hinge 192 may couple each door 126 to the housing 120. It should be noted that while two doors 126 in a "french door" configuration are illustrated, any suitable arrangement of doors utilizing one, two or more doors is within the scope and spirit of the present disclosure. A freezer door 130 is arranged below refrigerator doors 126, 128 for accessing freezer chamber 124. In the exemplary embodiment, freezer door 130 is coupled to a freezer drawer (not shown) slidably coupled within freezer chamber 124.

Figure 2:
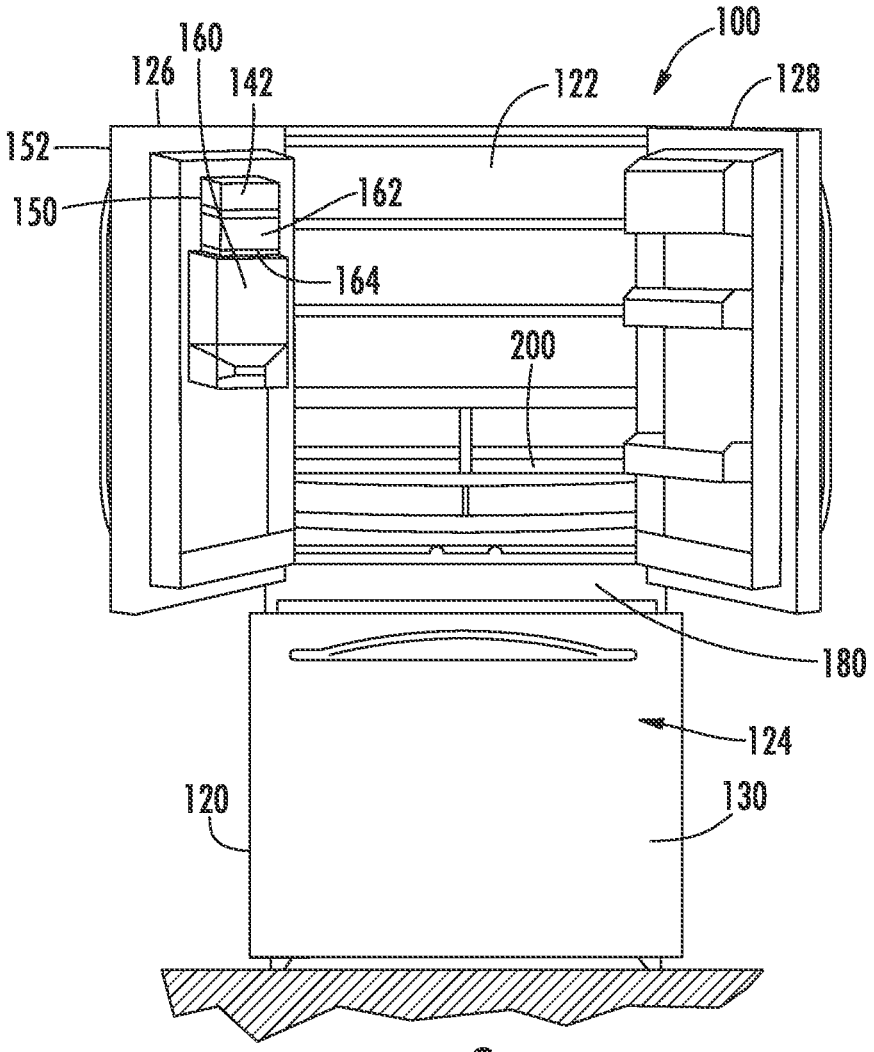
FIG. 2 provides a front view of the refrigerator appliance of FIG. 1 with refrigerator doors of the refrigerator appliance shown in an open configuration to reveal a fresh food chamber and freezer chamber of the refrigerator appliance.

FIG. 2 is a perspective view of refrigerator appliance 100 having refrigerator doors 126, 128 in an open position to reveal the interior of the fresh food chamber 122. Additionally, freezer door 130 is shown in an open position to reveal the interior of the freezer chamber 124.

A door 126 of the refrigerator appliance 100 may include an inner surface 150 and an outer surface 152. The inner surface 150 generally defines the interior of the fresh food chamber 122 when the door 126 is in a closed position as shown in FIG. 1, while the outer surface 152 is generally opposite the inner surface 150 and defines the exterior of the refrigerator appliance.

Refrigerator appliance 100 further includes a dispensing assembly 110 for dispensing water and/or ice. Dispensing assembly 110 includes a dispenser 114 positioned on an exterior portion of refrigerator appliance 100. Dispenser 114 includes a discharging outlet 134 for accessing ice and water. A single paddle 132 is mounted below discharging outlet 134 for operating dispenser 114. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and paddle 132 are an external part of dispenser 114, and are mounted in a recessed portion 138 defined in an outside surface of refrigerator door 126. Recessed portion 138 is positioned at a predetermined elevation convenient for a user to access ice or water enabling the user to access ice without the need to bend-over and without the need to access freezer chamber 124. In the exemplary embodiment, recessed portion 138 is positioned at a level that approximates the chest level of a user.

Further components of dispensing assembly 110 are illustrated in FIG. 2. Dispensing assembly 110 includes an insulated housing 142 mounted to door 126. Due to the insulation which encloses insulated housing 142, the temperature within insulated housing 142 can be maintained at levels different from the ambient temperature in the surrounding fresh food chamber 122.

The insulated housing 142 is constructed and arranged to operate at a temperature that facilitates producing and storing ice. More particularly, the insulated housing 142 contains an ice maker for creating ice and feeding the same to an ice container 160, both of which may be mounted on refrigerator door 126. As illustrated in FIG. 2, container 160 is placed at a vertical position on refrigerator door 126 that will allow for the receipt of ice from a discharge opening 162 located along a bottom edge 164 of insulated housing 142.

Referring now to FIGS. 3 through 13, various embodiments of a drain assembly 200 for a refrigerator appliance 100 are provided. Such drain assemblies 200 advantageously drain liquids, such as water, from the ice container 160.

Referring to FIGS. 3 through 8, some embodiments of a drain assembly 200 are illustrated. In these embodiments, drain assembly 200 provides a flow path through a hinge, such as lower hinge 192 and the mullion 180 to an exhaust location. Such drain assemblies 200 in these embodiments may be passive "gravity-assist" assemblies, which do not require the use of a pump or other active apparatus to drain such liquids. In exemplary embodiments, the exhaust location may be an evaporator pan 202 disposed adjacent to the back 109 of the refrigerator appliance 100, such as near the bottom 102 of the appliance 100 and extending generally along the horizontal direction H.

Figure 3:
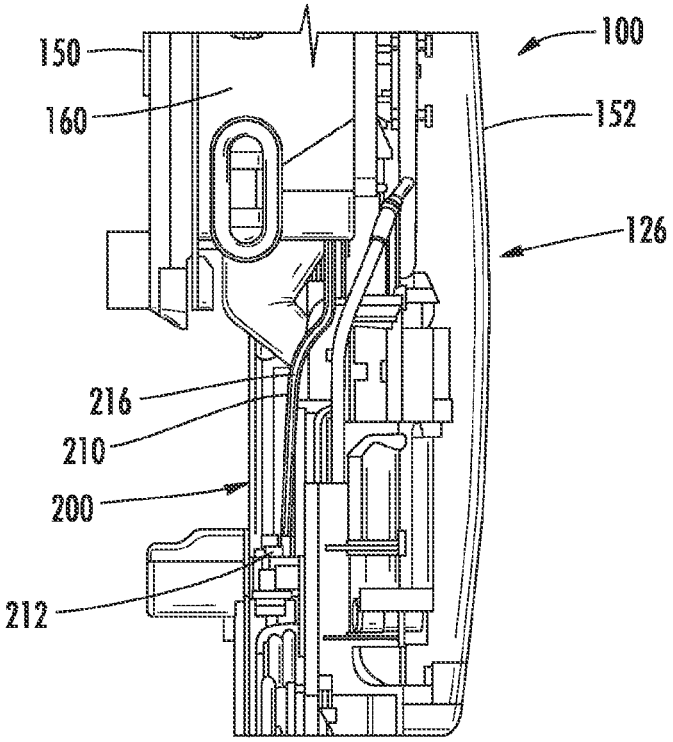
FIG. 3 provides a side view of a portion of the interior of a door of a refrigerator appliance according to an exemplary embodiment of the present subject matter.
Figure 4:
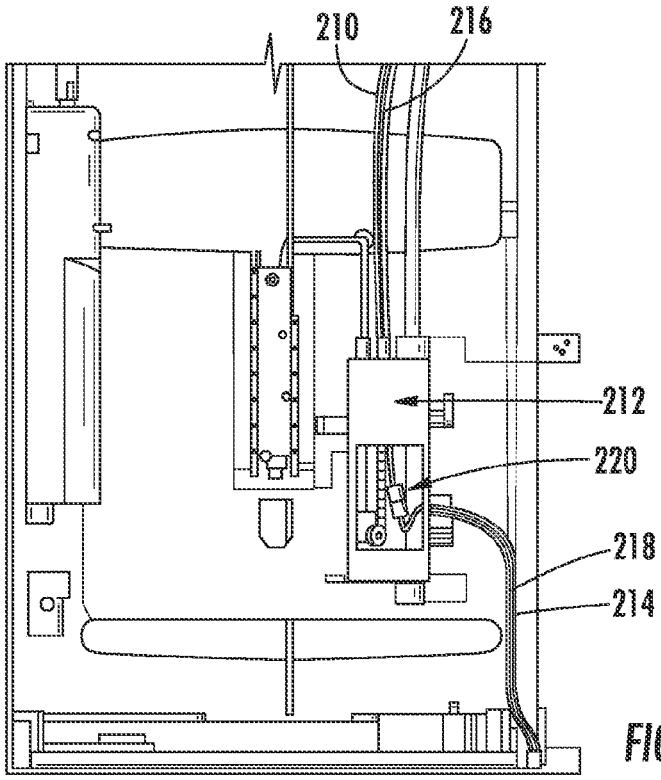
FIG. 4 provides a front view of a portion of the interior of a door of a refrigerator appliance according to an exemplary embodiment of the present subject matter.

Referring to FIGS. 3 and 4, the drain assembly 200 in these embodiments may for example include a first conduit 210 extending from the ice compartment 160. The conduit 210 may be in fluid communication with the ice compartment 160, such as through a passage defined in the ice compartment 160 that a portion of the conduit 210 surrounds. The conduit 210 as shown may be disposed within the door 126, such as between the inner surface 150 and outer surface 152 thereof.

As further illustrated, an electrical box 212 may be provided for the refrigerator appliance 100, and may be disposed within the door 126. Conduit 210 may extend between the compartment 160 and the electrical box 212, and for example partially extend into the electrical box 212. Further, a second conduit 214 may extend between the electrical box 212 and the hinge 192 (see FIGS. 5 and 6). The conduit 214 as shown may also be disposed within the door 126. Alternatively, however, a single conduit may extend between the ice compartment 160 and hinge 192, or through another suitable route to the hinge 192.

Tubing may facilitate liquid flow from the ice compartment 160 to the hinge 192. Thus, in exemplary embodiment, such tubing may extend through the various conduits 210, 214, which may direct the tubing and thus the liquid flow path. Alternatively, tubing may extend between the ice compartment 160 and hinge 192 without the need for outer conduits.

As illustrated, a first tube 216 may extend through the first conduit 210. The first tube 216 may be in fluid communication with the ice compartment 160, such as through the passage defined in the ice compartment 160. Liquid may thus flow through the tube 216 (and thus through first conduit 210). First tube 216 may extend into the electrical box 212 as illustrated, wherein the first tube 216 may be coupled to a second tube 218. Any suitable connection between the tubes 216, 218, such as a John Guest connector 220, is within the scope and spirit of the present disclosure. The second tube 218 may extend through the second conduit 214 and between the electrical box 212 and hinge 192. Liquid may thus flow through the tube 218 (and thus through the second conduit 214). Alternatively, a single tube may extend through the conduits 210, 214, or any suitable number of tubes may be utilized.

Figure 5:
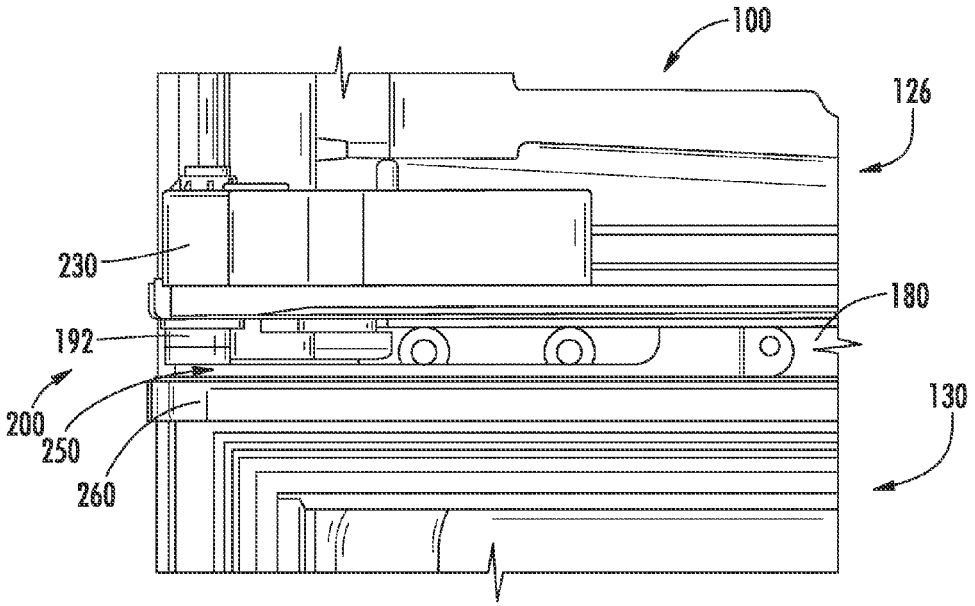
FIG. 5 provides a front view of a portion of a refrigerator appliance, including a hinge between a refrigerator door and freezer door, according to an exemplary embodiment of the present subject matter.
Figure 6:
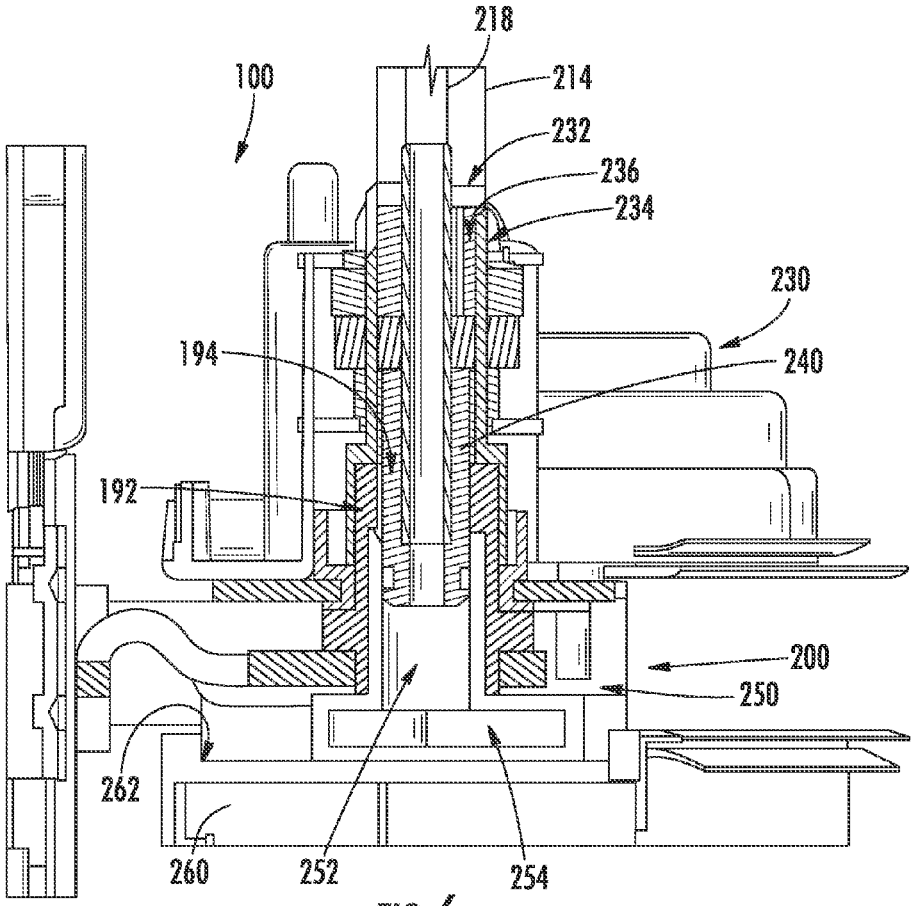
FIG. 6 provides a cross-sectional view of a portion of a refrigerator appliance, including a hinge between a refrigerator door and freezer door, according to an exemplary embodiment of the present subject matter.

Referring now to FIGS. 5 and 6, door 126 may include a bottom cap 230 which interacts with hinge 192. For example, bottom cap 230 may generally extend along the horizontal direction H (when the door 126 is closed), and may include a passage 232 extending generally in the vertical direction V which may cover a portion of the hinge 192, such as a passage 194 therein that also extends generally in the vertical direction V. A closure mechanism 234 may be disposed between the passage 232 and the passage 194, and may additionally define a passage 236 therein which extends generally in the vertical direction V.

Conduit 214 extending between the electrical box 212 and hinge 192 may contact bottom cap 230, and may for example, enclose a portion of the passage 232. Tubing which provides liquid from the ice compartment 160 may extend through the passages 232, 194, 236, as illustrated. In exemplary embodiments, the tubing may be second tube 218. A fitting 240 may disposed in the passages 232, 194, 236, through which tube 218 may additionally extend, may facilitate the connection of the tube 218 within the passages and prevent the tube 218 from being inadvertently removed. For example, fitting 240 may be overmolded to an end of the tube 218. Thus, liquid may be flowed through tubing to and through the hinge 192.

Figure 7:
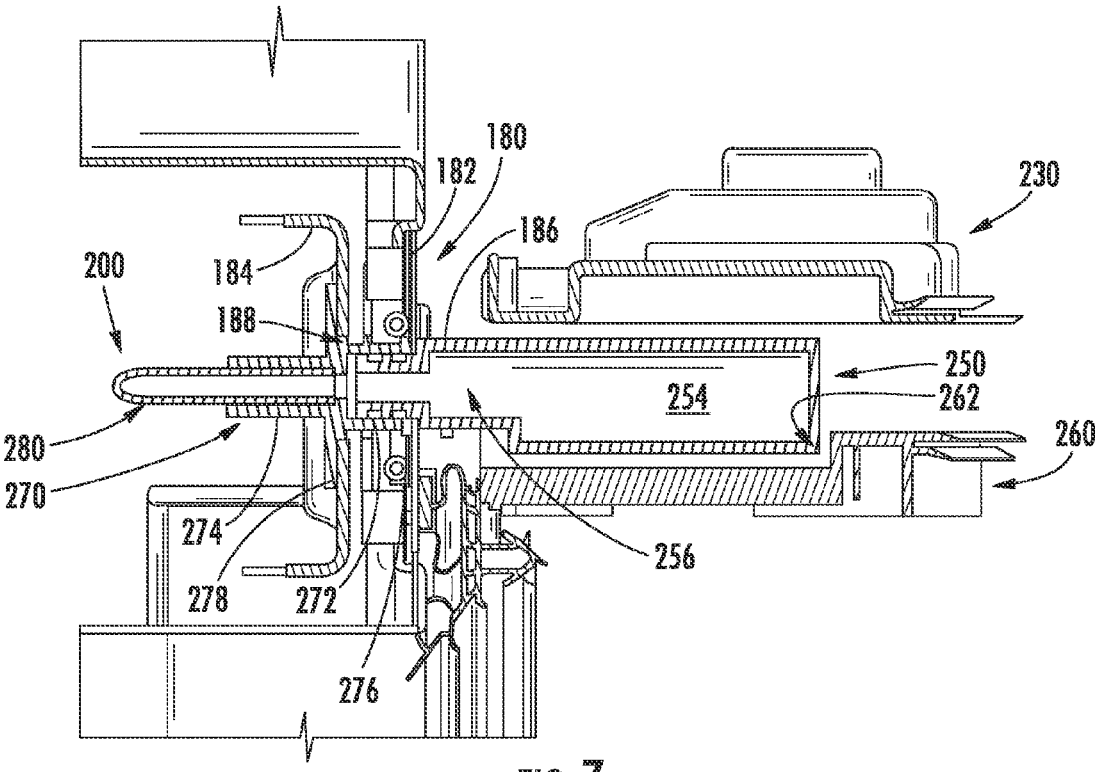
FIG. 7 provides another cross-sectional view of the portion of a refrigerator appliance illustrated in FIG. 6.

Referring still to FIGS. 5 and 6 as well as FIG. 7, drain assembly 200 may further include a flow connector 250. The flow connector 250 generally facilitates the flow of liquid from the hinge 192 through the mullion 180. For example, liquid flow through the flow connector 250 may generally be turned from flow generally in the vertical direction from hinge 192 to flow generally in the horizontal direction H to flow in the generally transverse direction T through the mullion 180.

As shown, flow connector 250 may thus define a first passage 252 that extends generally along the vertical direction. The passage 252 may extend through the hinge passage 194, and the tube 218 and fitting 240 may extend through the passage 252. Thus, liquid may flow from the tube 218 into the passage 252 and flow connector 250 generally.

Flow connector 250 may further include an annulus 254 extending generally along the horizontal direction H. The annulus 254 may be in fluid communication with the passage 252, such that liquid flowed through the passage 252 may enter the annulus 254 and flow through the annulus 254 generally in the horizontal direction H. Flow connector 250 may further include a second passage 256 extending generally along the transverse direction 256. The second passage 256 may be in fluid communication with the annulus 254, such that liquid flowed through the annulus 254 may enter the second passage 256 and flow through the second passage 256 generally in the transverse direction T. Accordingly, liquid may flow from the hinge 192 flow connector 250 and through the mullion 180.

Flow connector 250 may generally be disposed between the door 126 and the freezer door 130. Freezer door 130 may include a top cap 260, which may extend generally along the horizontal direction H (when door 130 is closed). In exemplary embodiments as illustrated in FIG. 7, a recess 262 may be defined in the top cap 260. Flow connector 250 may be disposed in the recess 262, and thus be situated between doors 126, 130.

Referring now to FIG. 7, the second passage 256 of flow connector 250 may extend through a bore hole defined in the mullion 180. For example, mullion 180 may include a front mullion panel 182 and a rear structural mullion panel 184, which may be spaced apart generally in the transverse direction T. A bore hole 186 may be defined in the front mullion panel 182, and a bore hole 188 may be defined in the rear structural mullion panel 184. Second passage 256 may extend through bore hole 186, as shown.

Drain assembly 200 may, as illustrated, further include a fitting 270 coupled to the flow connector 250 for flowing liquid from the flow connector 250. The fitting 270 may include a first passage 272 disposed between the rear structural mullion panel 184 and the front mullion panel 182. The fitting 270 may further include a second passage 274 in fluid communication with the first passage 272, which may for example extend opposite the first passage 272 such as generally along the transverse direction. The first passage 272 may further be in fluid communication with the second passage 256 of the flow connector 250, such as by enclosing a portion of the second passage 256, such that liquid may flow from the second passage 256 into the first passage 272. Such liquid may then flow from the first passage 272 through the second passage 274 of the fitting 270.

In exemplary embodiments as shown, a first flange 276 may extend from the first passage 272, and a second flange 278 may extend from the second passage 274. The first flange 276 may contact the front mullion panel 182, thus preventing the first passage 272 from extending through the bore hole 186. The second flange 278 may contact the rear structural mullion panel 184, thus preventing the second passage 276 from extending through the bore hole 188.

A tube 280 may extend from the fitting 270, and thus be in fluid communication with the fitting 270 for flowing the liquid therefrom. Second passage 274 may thus be connected to the tube 280, which may extend therefrom. Tube 280 may be inserted in (as shown) or enclose the second passage 274, such that liquid flowed to second passage 274 flows into and through tube 280.

Figure 8:
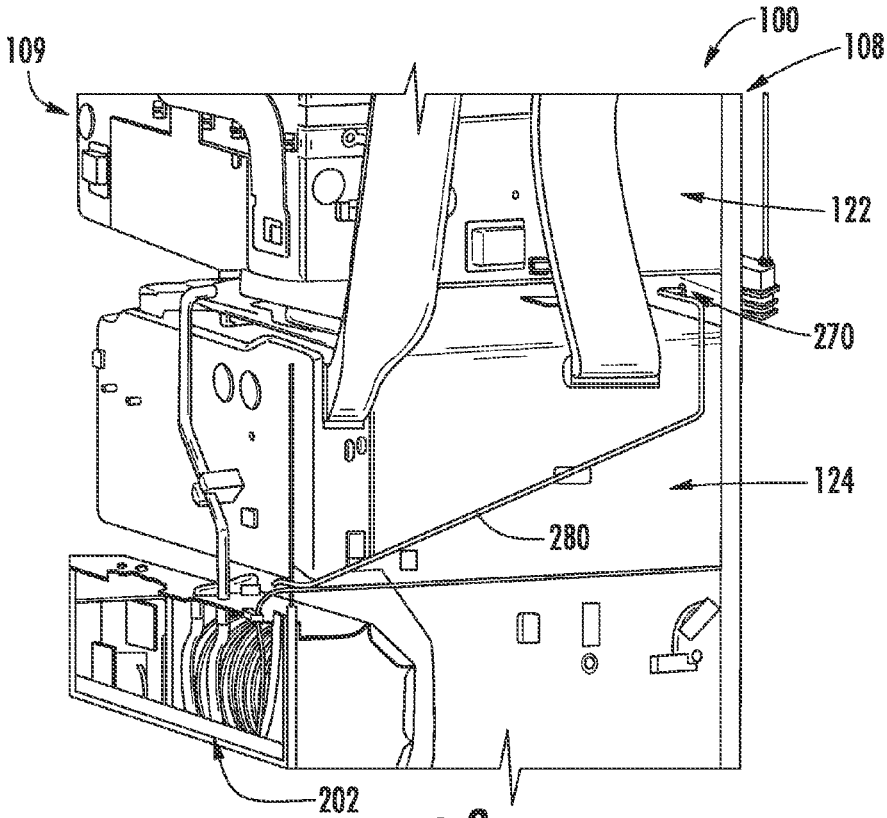
FIG. 8 provides a side view of a portion of a refrigerator appliance according to an exemplary embodiment of the present subject matter.

Referring now to FIG. 8, liquid flow through the mullion 180 via the flow connector 250 and fitting 270 to tube 280 may then be flowed in tube 280 to an exhaust location. As illustrated, tube 280 may be directed along the outside of freezer compartment 124 (between the compartment 124 and the housing 120) generally to the back 109 and bottom 102 of the appliance 100. Tube 280 may, for example, extend towards evaporator pan 202, and may flow the liquid to the evaporator pan 202.

Thus, such embodiments, facilitate the drainage of liquid along a flow path through the hinge 192 and mullion 180 to a suitable exhaust location.

FIGS. 9 through 11 illustrate other embodiments of the present disclosure. In these embodiments, a drain assembly 300 provides a flow path through a door 126 and a sidewall 170 to an exhaust location, such as to evaporator pan 202 as discussed above. Such drain assemblies 300 in these embodiments may also be passive "gravity-assist" assemblies, which do not require the use of a pump or other active apparatus to drain such liquids.

In these embodiments, a tube 302 may extend from ice compartment 160 within the door 126, and then through the door 126 into sidewall 170. In some embodiments, a conduit 304 may be disposed within the door 126 and in fluid communication with the ice compartment 160, and tube 302 may extend through the conduit 304.

As illustrated, door 126 may include an inner door portion 310 and an outer door portion 312. Inner door portion 310 may include the inner surface 150 of the door 126, while outer door portion 312 may include the outer surface 152 of the door 126. The inner door portion 310 may generally be smaller (such as at least along the vertical direction V and the horizontal direction H when the door is closed) than the inner door portion 312. This allows sealing between the outer door portion 312 and the chamber 122, thus extending the inner door portion 312 into the chamber 122 when the door 126 is closed. In exemplary embodiments, the flow path for liquid from the ice compartment 160 may be provided through the inner door portion 312, such as through the side thereof. Thus, the tube 302 and optional conduit 304 may extend through the inner door portion 312.

In some embodiments as illustrated, a gasket 316 may be disposed between the door 126, such as the inner door portion 312, and the sidewall 170, such as the inner surface 172 thereof, into which the tube 302 extends. Tube 302 may extend through the gasket 316. Gasket 316 may generally protect the tube 302 and cover the tube 302 from view by a user of the refrigerator appliance 100.

A conduit 318 may be disposed in the sidewall 170, such as between the inner surface 172 and the outer surface 174. Tube 302 may extend into the sidewall 302 and through conduit 318, and may terminate in the conduit 318. Thus, liquid flowed from the ice compartment 160 through the tube 302 may flow from the tube 302 through the conduit 318.

A second tube 320 may extend from the conduit 318, and liquid flowed from the first tube 302 may flow into this second tube 320. The second tube 320 may extend within and through the sidewall 170, and may extend to an exhaust location, such as to the evaporator pan 202 as discussed above. For example, tube 320 may exit the sidewall 170 through the inner surface 172 or outer surface 174 thereof, and extend by or between chamber 124 and housing 120 to an exhaust location.

FIG. 10 illustrates the drain assembly 300 according to these embodiments with the door 126 in a closed position, while FIG. 11 illustrates the drain assembly 300 according to these embodiments with the door 126 in an open position. As illustrate, a portion of the tube 302 moves relative to conduit 318 when the door 126 is in the open position. Thus, tube 302 generally may have a length such that it extends through the conduit 218 when the door 126 is in the open position.

Thus, such embodiments facilitate the drainage of liquid along a flow path through the door 126 and sidewall 170 to a suitable exhaust location.

Figure 12:
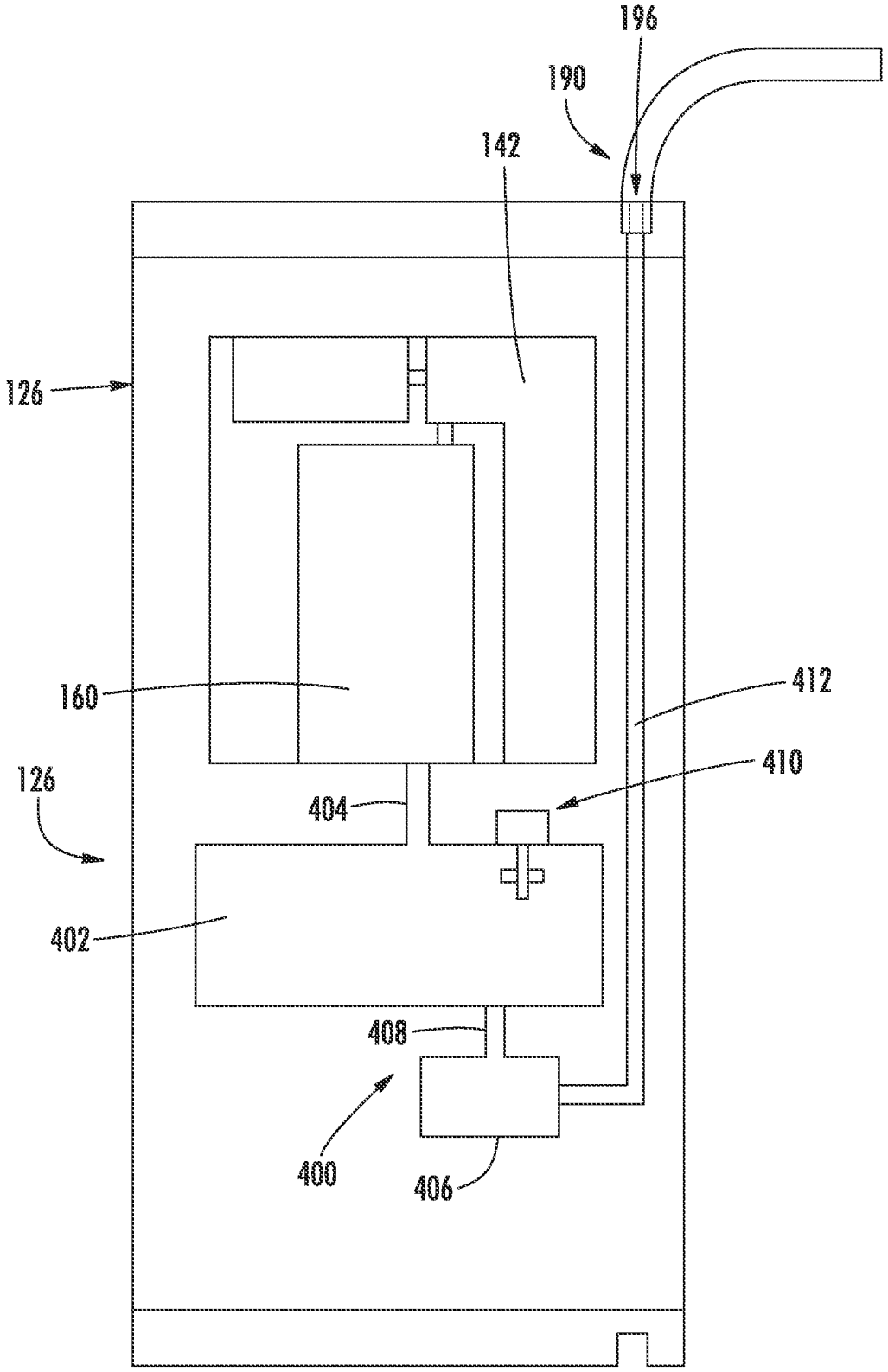
FIG. 12 provides a front view of a door of a refrigerator appliance according to an exemplary embodiment of the present subject matter.
Figure 13:
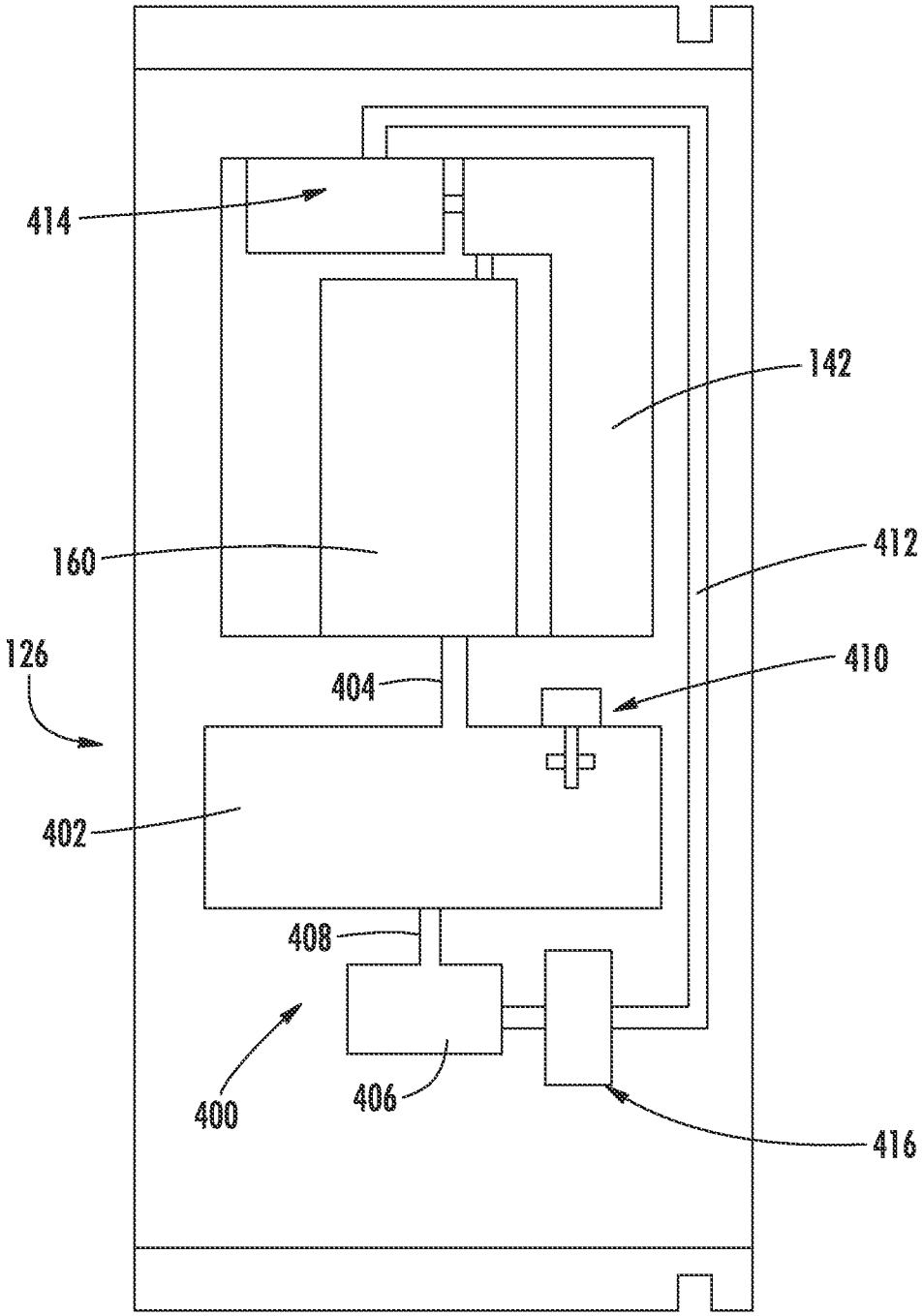
FIG. 13 provides a front view of a door of a refrigerator appliance according to an exemplary embodiment of the present subject matter.

FIGS. 12 and 13 illustrate other embodiments of the present disclosure. In these embodiments, a drain assembly 400 provides other suitable flow paths for liquid from the ice compartment 160. Such drain assemblies 200 in these embodiments may be active assemblies, which utilized pumps or other suitable devices to facilitate draining.

For example, as illustrated, drain assembly 400 may include a drain reservoir 402 mounted to or disposed within the door 126. The drain reservoir 402 may be in fluid communication, through for example a tube or conduit 404, with the ice compartment 160. Liquid may thus flow from the ice compartment 160 to the reservoir 402. Further, a pump 406 may be in fluid communication with the drain reservoir 402, for pumping liquid from the drain reservoir 402. Pump 406 additionally may be mounted to or disposed within the door 126. A tube or conduit 408 may provide such fluid communication.

A liquid level sensor 410 may be provided in the drain reservoir 402, as illustrated. Sensor 410 may sense the liquid level in the reservoir 402. Sensor 410 may be in communication with the pump 406, such as through a suitable wired or wireless connection, and may activate the pump 406 when a predetermined liquid level is met or exceeded in the reservoir 402. Thus, liquid flowed into the reservoir 402 may be flowed out of the reservoir 402 by and through the pump 406.

A drain tube 412 may extend from the pump 406, and may flow the liquid from the pump 406. Further, optional conduits (not shown) may house the tube 412 therein and direct the tube 412 from the pump 406. Tube 412 and optional conduits may be mounted to or disposed within the door 126.

In some embodiments, the drain tube 412 may be routed out of the door 126 to a suitable exhaust location, such as to evaporator pan 202. For example, as illustrated in FIG. 10, drain tube 412 may extend through hinge 190, such as through a passage 196 extending through the hinge 190 generally in the vertical direction V. The tube 412 may then extend towards a suitable exhaust location.

In other embodiments, the drain tube 412 may be routed to recycle the liquid. Thus, for example, the drain tube 412 may extend to and be in fluid communication with a liquid reservoir 414 which may be mounted to or disposed within the door 126 and in fluid communication with the insulated housing 142 in which the ice maker is disposed. The drain tube 412 may thus exhaust the liquid into the liquid reservoir 414, where it may further be flowed into the housing 142 and made into ice. In these embodiments, a filter 416 may additionally be provided along the flow path, such as between and in fluid communication with the pump 406 and drain tube 412. The liquid may flow through the filter 416 and thus be filtered before reuse in the insulated housing 142.

Thus, such embodiments facilitate various active embodiments for the drainage of liquid along various flow paths.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food chamber and a freezer chamber and comprising a mullion extending between and defining the fresh food chamber and freezer chamber, the mullion comprising a front mullion panel and a rear structural mullion panel;

a door rotatably hinged to the cabinet for accessing the fresh food chamber, the door comprising an inner surface and an outer surface, the door further comprising an ice container mounted thereon;

a hinge connecting the mullion and the door;

a freezer door connected to the cabinet for accessing the freezer chamber;

a drain assembly for draining a liquid from the ice container, the drain assembly comprising a fitting comprising a first passage disposed between the rear structural panel and the front mullion panel and a second passage extending opposite the first passage generally along a transverse direction, the drain assembly providing allow path through the hinge and the mullion to an exhaust location.

2. The refrigerator appliance of claim 1, wherein the door further comprises an electrical box mounted between the inner surface and the outer surface, and wherein the drain assembly further comprises a first conduit extending between the ice container and the electrical box and a second conduit extending between the electrical box and the hinge.

3. The refrigerator appliance of claim 2, wherein the drain assembly further comprises a first tube extending through the first conduit and a second tube extending through the second conduit, the first tube and the second tube coupled together.

4. The refrigerator appliance of claim 1, wherein the hinge and a bottom cap of the door each defines a passage extending generally along a vertical direction, and wherein the drain assembly comprises a tube extending through the passages.

5. The refrigerator appliance of claim 4, wherein the tube further extends through a fitting disposed in the passages.

6. The refrigerator appliance of claim 4, wherein the drain assembly further comprises a flow connector, the flow connector defining a first passage extending generally along the vertical direction through the passage of the hinge.

7. The refrigerator appliance of claim 6, wherein the flow connector further comprises an annulus extending generally along a horizontal direction, the annulus in fluid communication with the first passage, and a second passage extending generally along a transverse direction, the second passage in fluid communication with the annulus.

8. The refrigerator appliance of claim 6, wherein a top cap of the freezer door defines a recess, and wherein the flow connector is disposed in the recess.

9. The refrigerator appliance of claim 7, wherein the second passage extends through a bore hole defined in the mullion.

10. The refrigerator appliance of claim 1, wherein the first passage comprises a first flange in contact with the front mullion panel and the second passage comprises a second flange in contact with the rear structural mullion panel.

11. The refrigerator appliance of claim 1, further comprising a tube extending from the second passage.

12. A refrigerator appliance, comprising:

a cabinet defining a fresh food chamber and a freezer chamber and comprising a mullion extending between and defining the fresh food chamber and freezer chamber;

a door rotatably hinged to the cabinet for accessing the fresh food chamber, the door comprising an inner surface and an outer surface, the door further comprising an ice container mounted thereon;

a hinge connecting the mullion and the door, the hinge and a bottom cap of the door each defining a passage extending generally along a vertical direction;

a drain assembly for draining a liquid from the ice container, the drain assembly comprising a tube and a flow connector, the tube extending through the passages, the flow connector defining a first passage extending generally along the vertical direction through the passage of the hinge, the drain assembly providing a flow path through the hinge and the mullion to an exhaust location; and a freezer door connected to the cabinet for accessing the freezer chamber, the freezer door comprising a top cap defining a recess in which the flow connector is disposed.

13. The refrigerator appliance of claim 12, wherein the door further comprises an electrical box mounted between the inner surface and the outer surface, and wherein the drain assembly further comprises a first conduit extending between the ice container and the electrical box and a second conduit extending between the electrical box and the hinge.

14. The refrigerator appliance of claim 13, wherein the drain assembly further comprises a first tube extending through the first conduit and a second tube extending through the second conduit, the first tube and the second tube coupled together.

15. The refrigerator appliance of claim 12, wherein the tube further extends through a fitting disposed in the passages.

16. The refrigerator appliance of claim 12, wherein the flow connector further comprises an annulus extending generally along a horizontal direction, the annulus in fluid communication with the first passage, and a second passage extending generally along a transverse direction, the second passage in fluid communication with the annulus.

17. The refrigerator appliance of claim 16, wherein the second passage extends through a bore hole defined in the mullion.

* * * * *